US006595294B1

(12) United States Patent
Dalsmo et al.

(10) Patent No.: US 6,595,294 B1
(45) Date of Patent: Jul. 22, 2003

(54) METHOD AND DEVICE FOR GAS LIFTED WELLS

(75) Inventors: Morten Dalsmo, Oslo (NO); Lars Nøkleberg, Jar (NO); Veslemøy Kristiansen, Oslo (NO); Kjetil Havre, Skedsmokorset (NO); Bård Jansen, Oslo (NO)

(73) Assignee: ABB Research Ltd., Billingstad (NO)

( * ) Notice: Subject to any disclaimer, the term of this patent is extended or adjusted under 35 U.S.C. 154(b) by 0 days.

(21) Appl. No.: 09/719,979

(22) PCT Filed: Jun. 25, 1999

(86) PCT No.: PCT/NO99/00217

§ 371 (c)(1),
(2), (4) Date: Apr. 4, 2001

(87) PCT Pub. No.: WO00/00715

PCT Pub. Date: Jan. 6, 2000

(30) Foreign Application Priority Data

Jun. 26, 1998 (NO) ..... 19982973

(51) Int. Cl.[7] ..... E21B 43/00

(52) U.S. Cl. ..... 166/369; 166/250.01; 166/66; 166/91.1

(58) Field of Search ..... 166/369, 370, 166/372, 250.01, 250.07, 263, 305.1, 66.6, 66, 91.1; 703/9, 10

(56) References Cited

U.S. PATENT DOCUMENTS

| | | | | |
|---|---|---|---|---|
| 4,738,313 A | | 4/1988 | McKee | |
| 5,014,789 A | | 5/1991 | Clarke et al. | |
| 5,636,693 A | * | 6/1997 | Elmer | 166/370 |
| 5,871,048 A | * | 2/1999 | Tokar et al. | 137/155 |
| 5,975,204 A | * | 11/1999 | Tubel et al. | 166/250.15 |

FOREIGN PATENT DOCUMENTS

| | | |
|---|---|---|
| GB | 22766675 | 10/1994 |
| WO | 9425732 | 11/1994 |
| WO | 9704212 | 2/1997 |

* cited by examiner

*Primary Examiner*—William Neuder
*Assistant Examiner*—Jennifer R Dougherty
(74) *Attorney, Agent, or Firm*—Volpe and Koenig, P.C.

(57) ABSTRACT

A method and stabilizing gas lift controller for controlling the production flow rate of an oil well, which well comprises at least one gas injection choke (3) and/or at least one production choke (2), the choke or chokes being controlled as a function of process measurements, characterized in that pressure, temperature and flow rates are stabilized through active feedback control and continuous manipulation of said choke or chokes as a dynamic function of available process measurements.

29 Claims, 25 Drawing Sheets

METHOD AND DEVICE FOR GAS LIFTED WELLS

FIELD OF INVENTION

An automatic model-based controller is used for stabilization of gas lifted oil wells. The controller stabilizes the pressures, temperatures and flow rates in the well through active feedback control and continuous manipulation of the opening of the production choke and/or the opening of the gas injection choke as a dynamic function of available process measurements.

The system comprises a production choke for control of the product from the oil well and/or a gas injection choke for control of lift-gas to the annulus.

BACKGROUND

Unstable production conditions often occur for oil wells where gas lift is used to increase the oil production. This is a serious problem due to the fact that the instabilities often occur in the most optimal area of operation for the gas lifted wells, thus causing the well to produce less than the system design capacity.

Unstable production of gas lifted wells is not in agreement with smooth operation and it implies safety aspects and shutdown risks. The total oil and gas production must usually be less than the systems design capacity (e.g. of the separators) to allow for the peak production. Unstable operation decreases sharply the lift gas efficiency, and leads to difficulties with gas lift allocation computation.

Unstable production of gas lifted wells may be caused by a large variety of factors, such as incorrect gas lift string design, improper valve setting, wrongly sized injection valve port, variation in supply pressure, or valve leaking or plugging. It is often difficult to find the origin of the instabilities. As a result, a pragmatic approach has often been used to solve the problem of unstable production in short term. For example, if unstable production occurs, the operator often increases the amount of lift gas or increases the back-pressure by adjusting the wellhead production choke to a smaller opening (choking). Although these methods can be effective in reducing the instabilities, the production is still inefficient as either too much lift gas is used (high cost and limited availability of lift gas) or the well is producing against a high back pressure (at low rate). In most cases, too much gas is injected into the gas lifted wells or the production rate is not maximized.

SUMMARY OF THE INVENTION

The present invention relates to a method and a stabilizing well controller for stabilization of gas lifted oil wells without using lift-gas in an inefficient way or by introducing a high static back pressure. The characterizing features of the method are given in claim 1. The characterizing features of the stabilizing well controller are given in claim 14.

This concept for a model-based stabilizing gas lift controller for automatic and on-line control represents a number of inventive steps. First and foremost, our concept is able to stabilize the pressures, temperatures and flow rates of a gas lifted well in an operating point that is unstable in open-loop (i.e., when no active control is used). The unstable production phenomena for a gas lifted well is eliminated, without increasing the mean gas lift injection rate, through active and continuous manipulation of the opening of the production choke and/or the opening of the gas injection choke as a dynamic function of available process measurements. The model-based stabilizing gas lifted well controller provides a way to stabilize gas lifted wells with different measurement devices (sensors) available for control purposes.

The model based stabilizing gas lifted well controller is also characterized in that it allows that the control error, which is a function of an externally given (optimal) reference operating point and the real operating point, at any time may be minimized with respect to a predefined model-based (integral) norm.

DETAILED DESCRIPTION OF THE INVENTION

Figure 1:
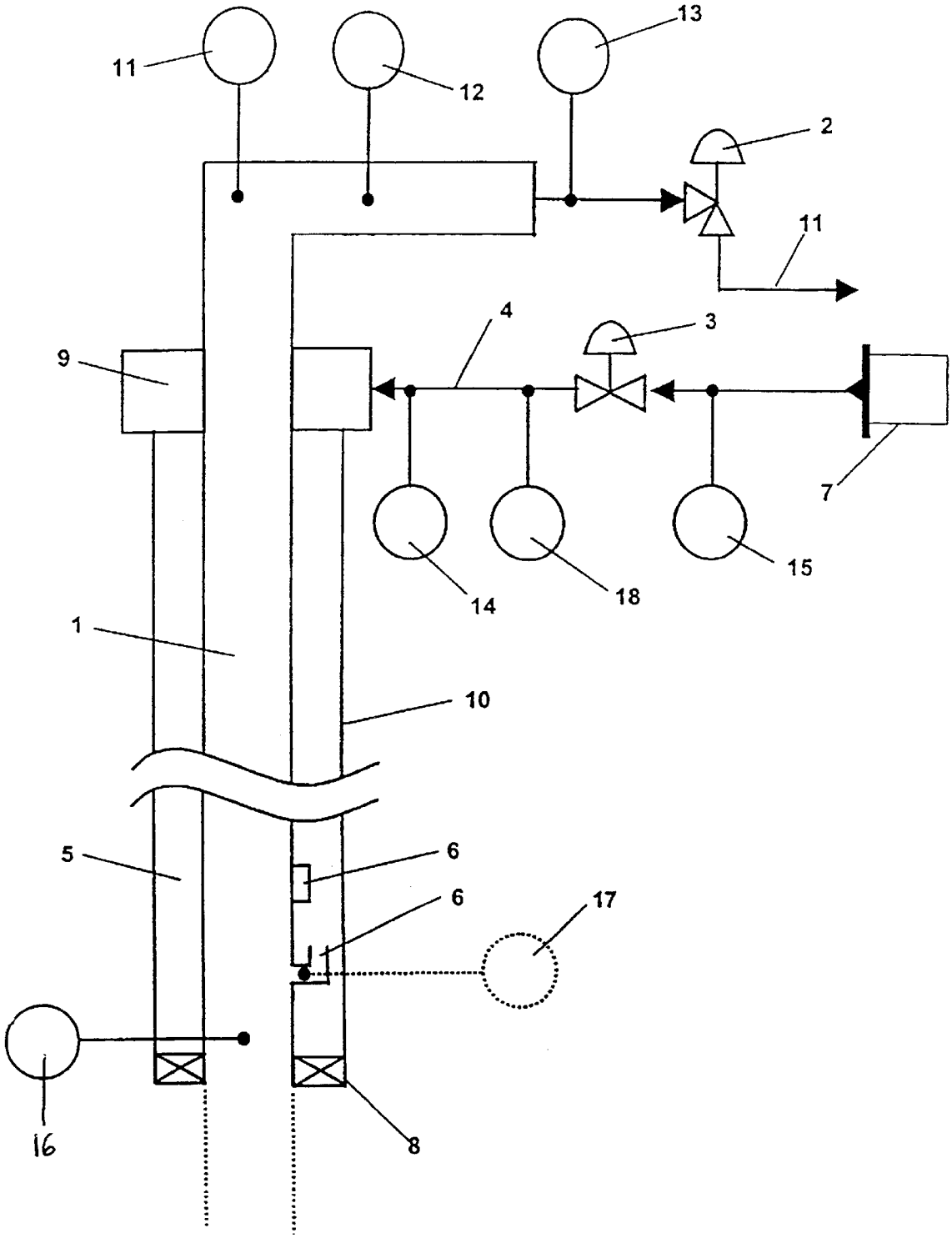
FIG. 1 shows a schematic of a gas lifted oil well including the most common measurements.

Referring now to FIG. 1, there is shown a schematic of a gas lifted oil well comprising a production tubing 1, a variable choke 2 for controlling the production rate and a variable choke 3 for controlling the injection of lift gas. The production choke 2 is mounted in a production tubing 1 and the gas injection choke is mounted on the gas injection flow-line 4. The well has either an annular space 5 between the production tubing 1 and the casing 10, or a separate gas supply tubing for injection of pressurized gas from the source 7 into the lower end of the production tubing 1. One or more gas lift valves/nozzles 6 (unloading valves) are evenly distributed alongside the production tubing 1; and during normal operation the gas is usually injected through the deepest of these valves. In the case of an annular space 5 (annular space 5 is shown in FIG. 1), a packer 8 is mounted near the lower end of the production tubing 1 to stop fluid from penetrating into the annular space 5 which is filled with pressurized gas.

A wellhead assembly 9 makes the annular space leak-tight and may be equipped with devices for measurement of both wellhead pressure 11 and wellhead temperature 12. In some cases it is also possible to measure the production flow rate 13 directly. In addition, the gas-conduit 4 may include a device 14 for measurements of pressure in the annular space (casing/annulus pressure), a temperature sensor for measurement of the annulus (casing) temperature 18, and a device 15 for measurement of flow rate of the pressurized gas. Some wells are also equipped with sensors for measurements of the bottom hole pressure 16. At present time there exist no measurement devices for measurement of the gas injection rate 17 from annulus 5 to the production tubing 1 (referred to as Lift Gas Rate (LGR)), however, it is possible to estimate this quantity.

Figure 2:
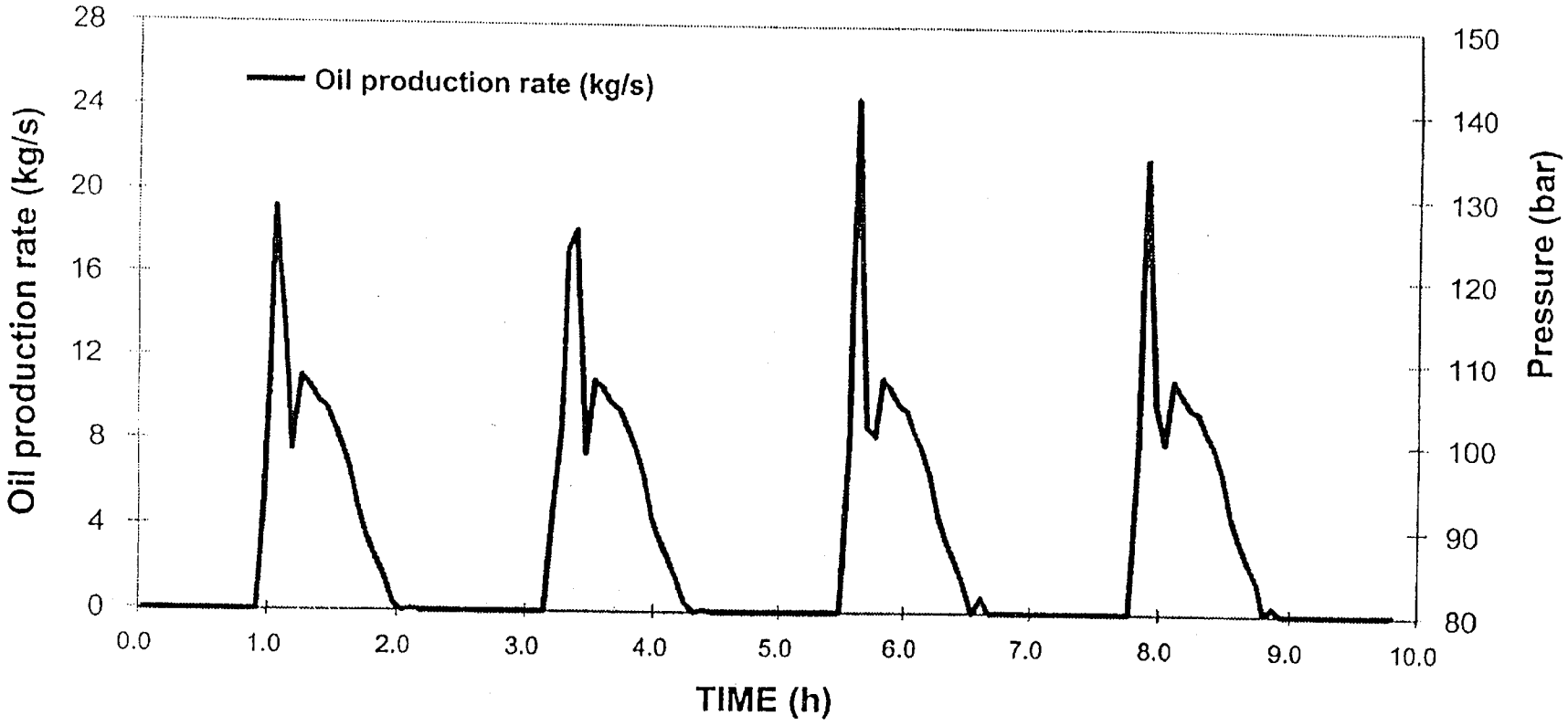
FIG. 2 shows unstable production versus time for a gas lifted oil well simulated in the multiphase simulator OLGA.

FIG. 2 shows a typical unstable production sequence (also referred to as heading, casing heading or heading limit cycles) versus time from a gas lifted oil well. At the highest gas injection rates, the pressure drops in the tubing 1 is dominated by friction. If the gas-oil-ratio rises, the tubing pressure will increase which will reduce the gas injection rate. This region therefore ensures stable production. At low gas injection rates however, the hydrostatic pressure gradient dominates the pressure drop in the production tubing 1. A small increase in gas-oil-ratio results then in a lower pressure in the tubing 1, which leads to a higher gas injection rate 17 from the annular space 5 into the production tubing 1 through the down-hole gas lift valve 6. Since the gas rate is restricted by a gas injection choke 3 at the wellhead 9, the gas pressure in the annular space 14 will be reduced. After a time, the gas rate into the production tubing 17 will therefore be reduced, resulting in a lower oil production rate. At low gas injection rates the well is therefore intrinsically unstable in spite of the fact that wells are operated most efficiently on the upward slope of the lift performance relationship curve.

Figure 3:
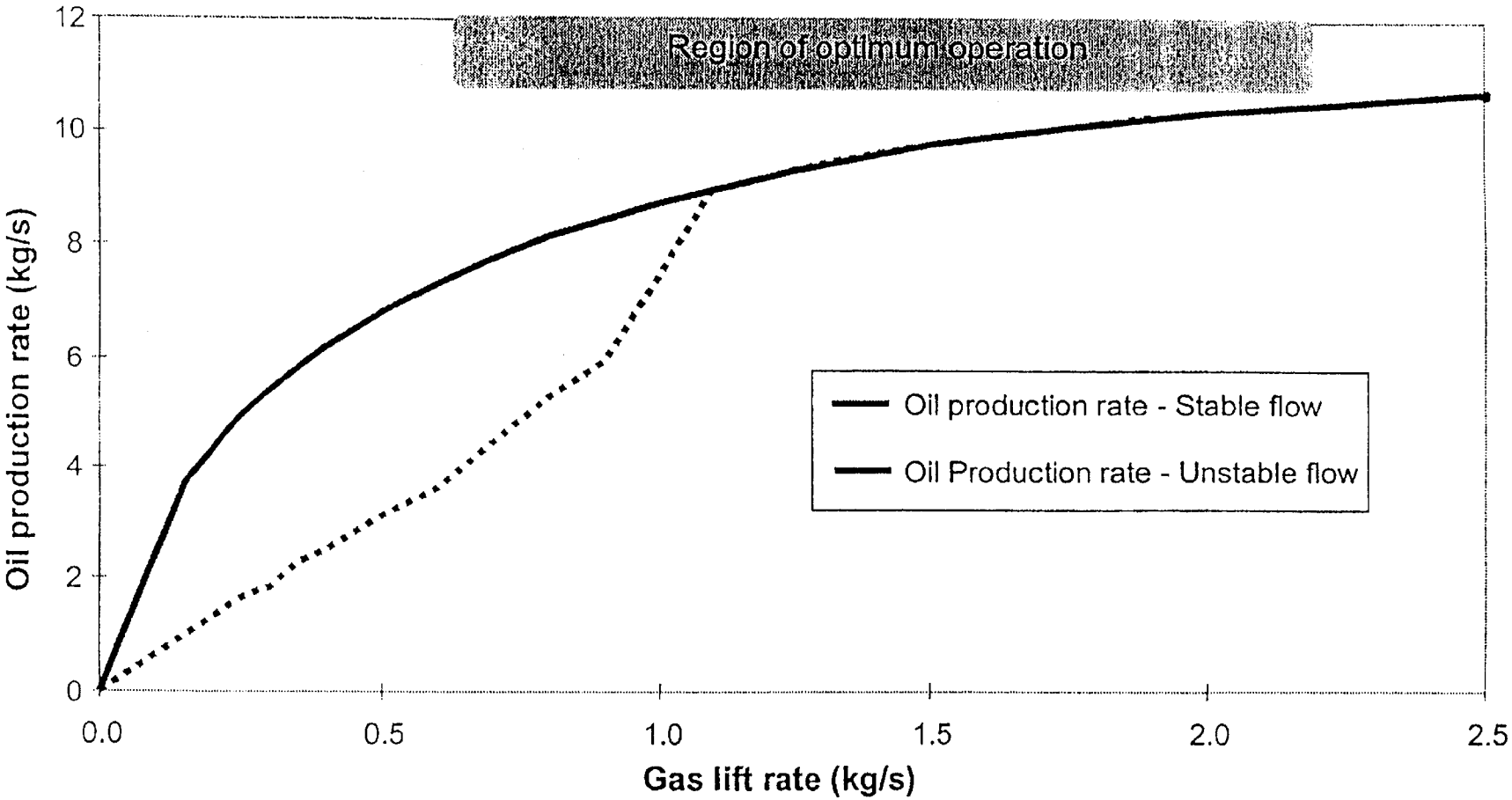
FIG. 3 shows a typical lift performance relationship curves for both a stable and an unstable gas lifted oil well.

FIG. 3 shows a typical lift performance relationship curves for gas lifted wells. The solid curve corresponds to injecting lift gas directly through the lowest gas injection valve 6 at constant rate. Obviously, this is not possible, and the dotted curve shows the resulting average production when the lift gas is injected at constant rate through the gas injection choke 3. In both cases the resulting oil production rate are shown as a function of the amount of injected lift gas. Due to unstable production at low gas injection rates when injection the lift gas through the gas injection choke 3, it is seen from FIG. 3 that the loss in average production is high for unstable production conditions (dotted curve) as compared to stable operating conditions (solid curve). With the invented model-based stabilizing controller presented here it is claimed that the well in FIG. 3 may be operated on or in infinitesimal distance from the stable solid curve.

Figure 4:
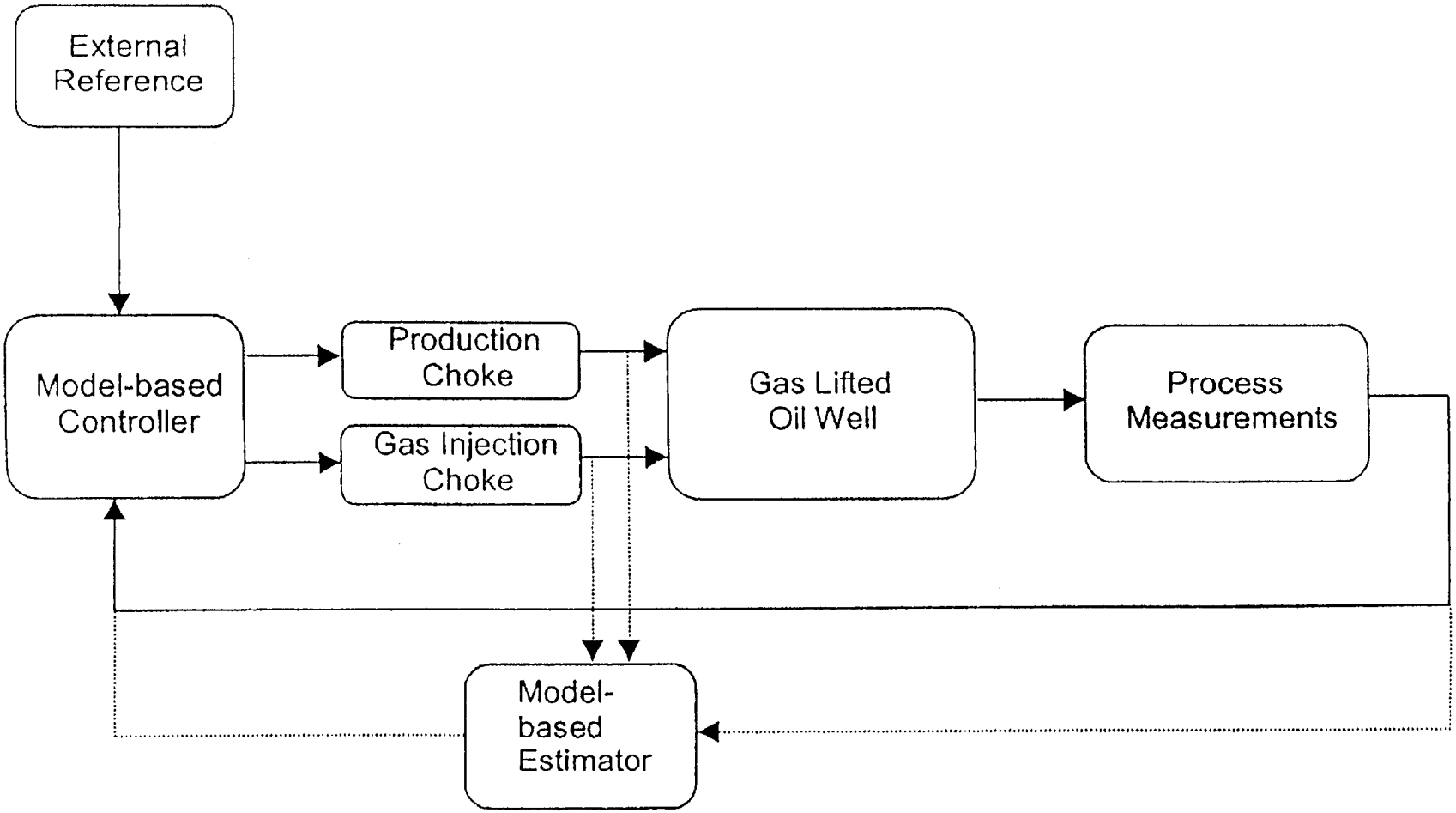
FIG. 4 shows a schematic of the invented control structure.

FIG. 4 shows a schematic of the invented model-based stabilizing gas lift controller structure. The model-based gas lift controller uses an externally given (optimal) reference point and one or more process measurements (or an estimate of these) to calculate the opening of the production choke 2 and/or the gas injection choke 3. The preferred mode for the externally given reference point is the specification of the optimal LGR 17 (gas rate through the down-hole gas injection valve).

In order to analyze and design controllers for gas lifted wells, our innovative idea is to design the stabilizing controller, and, if applicable, the estimator based on a dynamic model of the system. Therefore we have invented a structure for a simplified dynamic non-linear model based on physical principles of gas lifted wells suitable for controller and estimator design. The main purpose with this dynamic model is to describe the interactions between the annular space 5 and tubing 1 which leads to the unstable behavior (heading limit cycles) at low and intermediate gas injection rates. In addition it is necessary that the model becomes stable at high gas injection rates.

The idea is to use a simple model basically relying on three differential equations conserving mass in the tubing 1 and casing 5, and a couple of algebraic equations (of state) for approximating energy and impulse balances. At the cost of a more complicated, yet accurate, model, differential equations describing energy balances and impulse balances may also be included.

The invented structure of a nonlinear dynamic gas lifted well model consists of:

Model of the pipes (casing 5 and tubing 1):

1. Three ordinary differential equations conserving masses in casing 5 and tubing 1.
2. Algebraic equations (of state) relating pressure, temperature, and liquid and gas holdup to each other in casing 5 and tubing 1.
3. Algebraic equations for pressure head.

Model of gas injection choke 3: An algebraic equation describing the relation between the pressure upstream and downstream the gas injection choke 3 and the mass flow rate through the choke. One possible equation to be used is:

$$w_{liftgas} = C_{(3)}u_{(3)}\sqrt{\frac{M_{liftgas}}{z_{liftgas}RT}}\sqrt{p_{u,(3)}(p_{u,(3)} - p_{d,(3)})}$$

Here, $w_{liftgas}$ is the mass flow rate through the gas injection choke 3, $u_{(3)}$ is the opening of the gas injection choke 3, and $p_{u,(3)}$ and $P_{d,(3)}$ are the upstream and downstream pressures of the gas injection choke 3. $C_{(3)}$ is a constant parameter depending the gas injection choke used.

Model of the gas injection nozzle 6: An algebraic equation describing the relation between the pressure upstream and downstream the gas injection nozzle 6 and the mass flow rate through the nozzle 17. The equation will vary depending on the type of gas injection valve used.

Model of the production choke 2: An algebraic equation describing the relation between the pressure upstream and downstream the production choke 2 and the mass flow rate 3 of gas and liquid through the choke 2. One possible equation to be used is:

$$w_{total}=C_{(2)}u_{(2)}\sqrt{p_{(mix)}}\sqrt{(p_{u,(2)-p_{d,(2)})}}$$

Here, $w_{total}$ is the total mass flow rate through the production choke 2, $u_{(2)}$ is the opening of the production choke 2, and $p_{u,(2)}$ and $p_{d,(2)}$ are the upstream and downstream pressures of the production choke 2. $C_{(2)}$ is a constant parameter depending the production choke used The advantages with the invented model structure are:

It is compact (only a set of ordinary differential equations and algebraic equations)

It is able to capture the main dynamic behavior of gas lifted well both at low, medium (unstable operating conditions) and high (stable operating conditions) gas injection rates.

The model may easily be linearized, meaning that it is suitable for controller and estimator design.

The parameters in the model can be tuned so that the model fits measured real time-series of pressures, temperatures, and flow rates from a gas lifted well.

Figure 5:
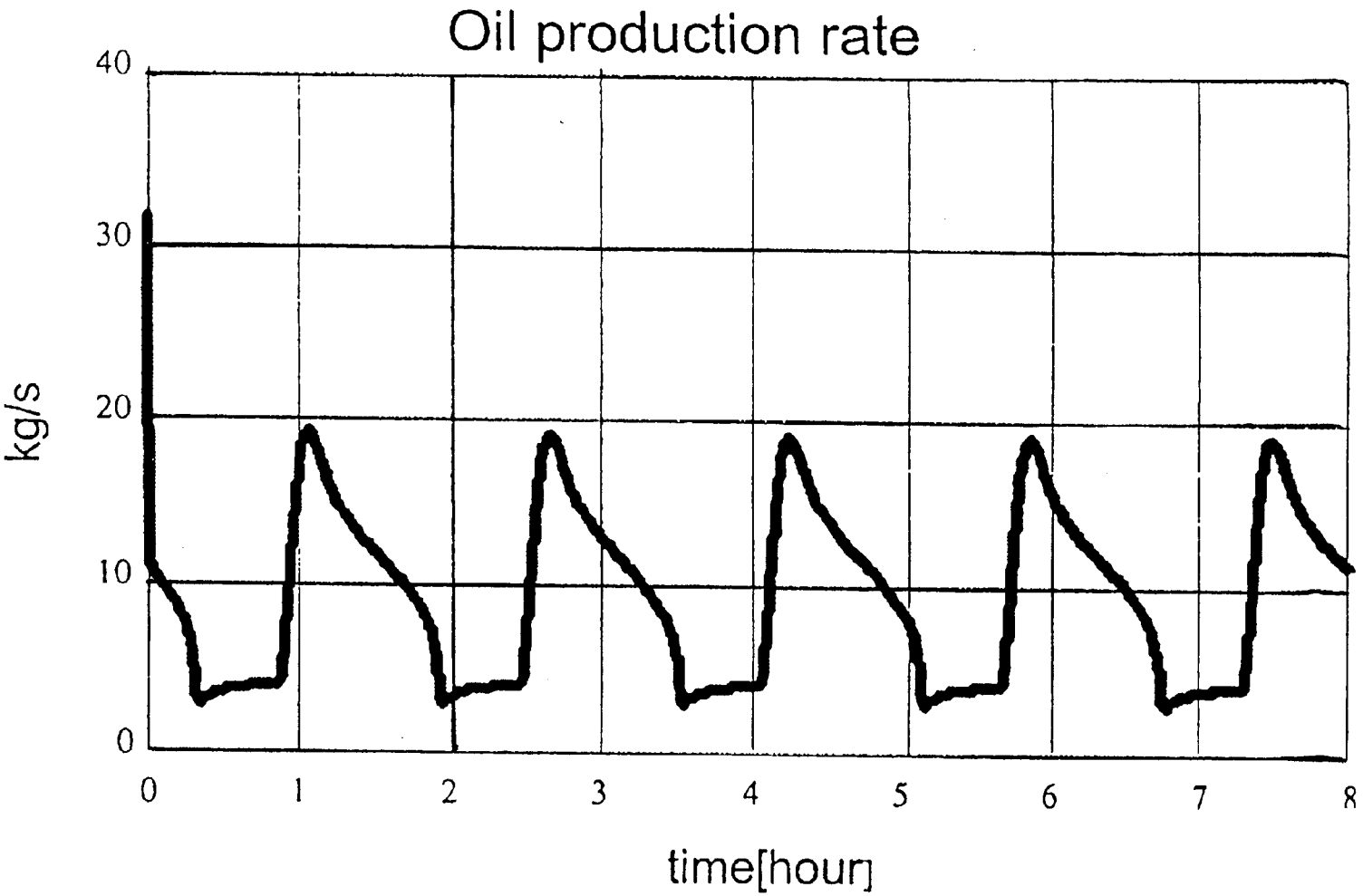
FIG. 5 shows an open loop simulation for an experimental gas lifted using a invented nonlinear gas lifted well model.

The parameters in the model can be tuned so that the model fits simulated time-series of pressures, temperatures, and flow rates from a gas lifted well modeled in a rigorous multiphase simulator based on partial differential-algebraic equations FIG. 5 shows an open-loop simulation where the invented structure has been used to model an unstable experimental gas lifted well. The model has been implemented and simulated in MATLAB. As seen from the simulation results, the model is able to capture the oscillating limit cycle conditions, also known as casing heading, in the experimental gas lifted well.

A nonlinear dynamic gas lifted well model in accordance with the invented structure may be used directly as part of the model-based stabilizing gas lift controller shown in FIG. 4. However, it is sometimes difficult to design a model-based controller based on a nonlinear model. The preferred mode for utilizing the derived nonlinear model will therefore be linearization. To locally capture the dynamic behavior of an unstable operating point of a gas lifted oil well, the nonlinear model in accordance with the structure described above may be linearized in the current operating point of interest. Representing the local dynamics of a gas lifted well using a linear state-space model or, equivalently, a transfer function model then locally captures the dynamic behavior in the neighborhood of an unstable operating point. A linear state-space model of a gas lifted well will generally have the following format:

$$\dot{x}(t)=Ax(t)+Bu(t)+Ed(t)$$

$$y(t)=Cx(t)+Du(t)+Fd(t)$$

Here, x(t) is the n×1 state-space vector (in preferred mode n=3 with the state-space representing mass of gas in the annular space 5 and tubing 1 and mass of liquid in the tubing 1) . u(t) is the 2×1 vector of controller inputs (opening of production choke 2 and gas injection choke 3), d(t) is the k×1 vector of disturbances (k=5 in preferred mode see description below). Finally, y(t) is the p×1 vector of outputs (in preferred mode y(t) corresponds to measured and/or estimated physical quantity). The parameters of the matrices A,B,C,D,E and F depend on the operating point where the nonlinear model has been linearized. A more or less equivalent representation of this linear state-space model would be the corresponding transfer function representation:

$$y(s)=G(s)u(s)$$

$$G(s)=(C(sI-A)^{-1}B+D)$$

Here, y(s) and u(s) are the Laplace transforms of y(t) and u(t).

The linear state-space gas lifted well models have the following inputs:

Opening of the gas injection choke 3 and/or

Opening of the production choke 2 and it has the following outputs:

Wellhead pressure 11 and/or

Bottom hole pressure 16 and/or

Casing pressure 14 and/or

Mass rate of gas through gas injection valve 17 and/or

Casing temperature 18 and/or

Mass rate of gas through gas injection choke 15 and the following disturbances:

Pressure and temperature upstream the gas injection choke 3 and/or

Pressure and temperature in the reservoir and/or

Pressure downstream the production choke 2

Figure 6:
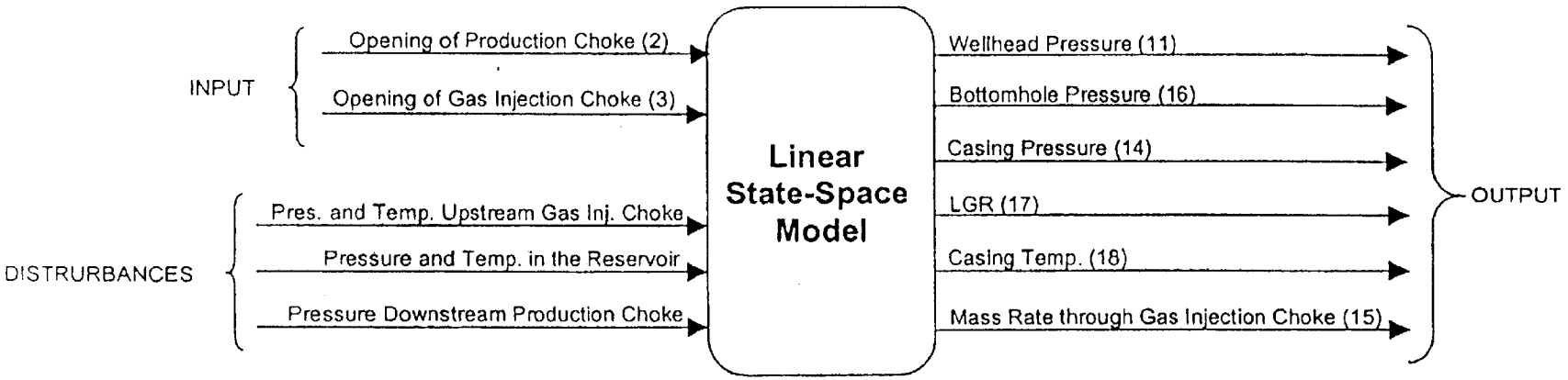
FIG. 6 shows an illustration of input, output, and disturbances for a linear state-space gas lifted well model.

FIG. 6 shows all possible inputs, outputs and disturbances for the linear state-space gas lifted well model.

We have invented two ways of generating these kind of linear gas lifted well models:

1. As already alluded to, by numerical or analytical linearization of a nonlinear dynamic gas lifted well model in accordance with our invented structure described above.

Example: From numerical linearization of the nonlinear gas lifted well model simulated in FIG. 5, we find that a typical transfer function from e.g. the gas injection choke 3 to the wellhead pressure 11 in an unstable operation point is given by:

$$G(s) = \frac{58.2(s + 6.3\cdot 10^{-4})}{(s - 8.8\cdot 10^{-4})(s - 2.9\cdot 10^{-3})(s + 7.3\cdot 10^{-2})}.$$

Figure 7:
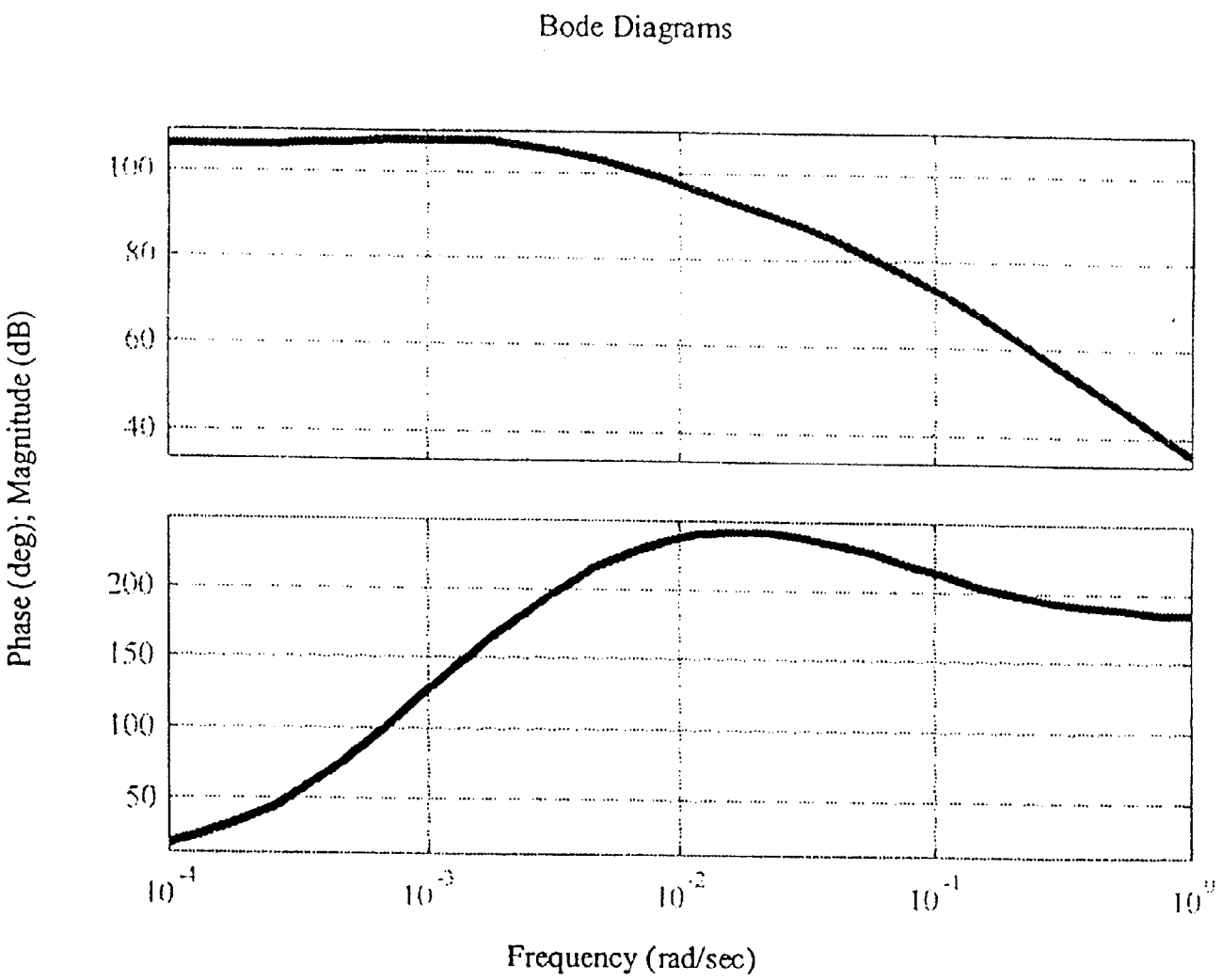
FIG. 7 shows a Bode plot of the transfer function from the gas injection choke to the wellhead pressure for an experimental gas lifted well.

It is immediately seen that there are two poles in the right half plane, which means that the system is unstable in open loop. Bode plots of G(s) are shown in FIG. 7.

2. By closed-loop identification experiments on a gas lifted oil well modeled in a multiphase pipeline simulator (OLGA) where the closed-loop system is stable in the operating point in question.

Figure 8:
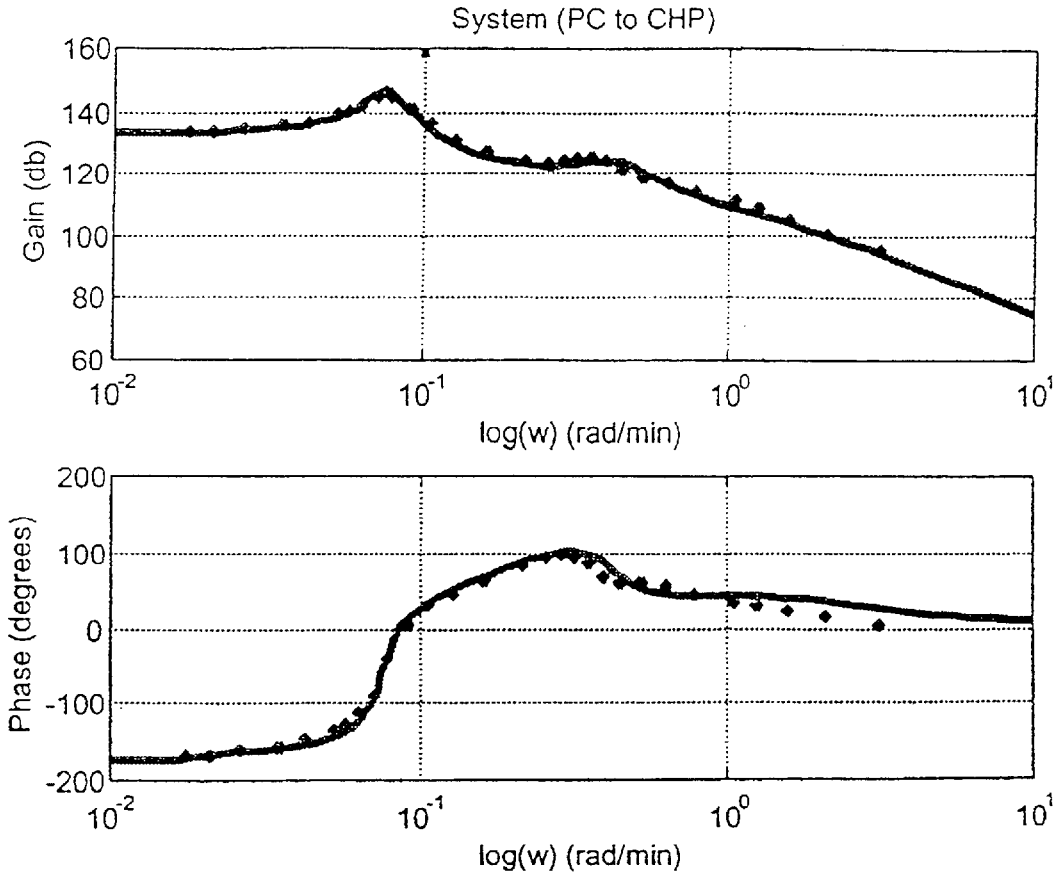
FIG. 8 shows a typical transfer function from the production curve to the casing pressure, both estimated value (x) and the fitted model (solid).

Example: By using ABB's MATLAB/OLGA link we have invented a way to run such experiments from MATLAB. An example of a transfer function identified in this way is given in FIG. 8, where the transfer function from the production choke 2 to casing head pressure in the nominal operation point of a typical gas lifted oil well have been identified using this approach.

Used in combination with advanced techniques from control theory, the linear local gas lifted well models (as described above) can be used to design model-based linear locally stabilizing gas lift controllers. In this way, an (optimal) operating point that is unstable in open-loop (i.e. without active control), becomes locally stable in closed-loop (i.e. when the stabilizing gas lift controller is actively used).

Figure 9:
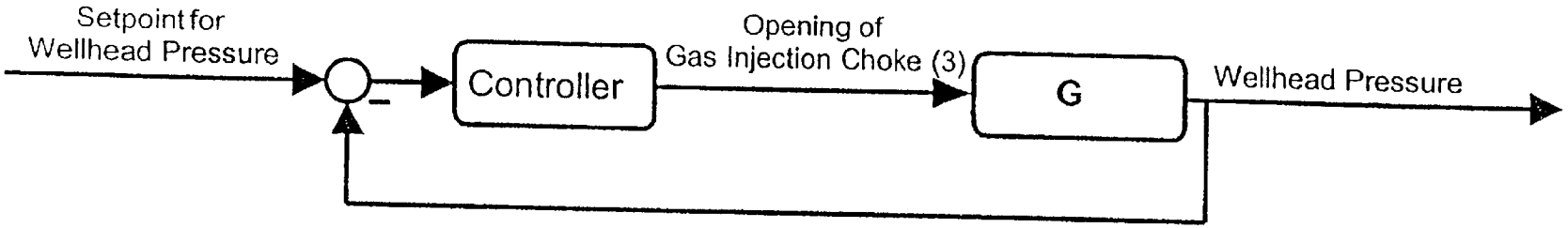
FIG. 9 shows a possible control structure for control of the wellhead pressure using the gas injection choke.

FIG. 9 shows an example where a simple SISO (Single Input Single Output) control structure is used for controlling the wellhead pressure 11 using the gas injection choke 3. Based on the typical transfer function from the gas injection choke to the wellhead pressure 11, it is straightforward to design a stabilizing controller. In this example, a controller given e.g. by:

$$Controller(s) = 5.70e-5\left(1+\frac{1}{3600s}\right)$$

Resulting in the following stable closed-loop poles:

−0.034+0.042i 0.034−0.042i

−0.00083

−0.00023

Generally, our linear locally stabilizing gas lift well controllers will become more complex than the simple SISO-controller illustrated above, and therefore we represent them in linear state-space form, or, equivalently, as transfer functions. A linear state-space model of a linear stabilizing gas lifted well controller will generally have the following format:

$$\dot{x}_c(t)=A_c x(t)+B_c y(t)+E_c r(t)$$

$$u(t)=C_c x_c(t)+D_c y(t)+F_c r(t)$$

Here, $x_c(t)$ is the n×1 controller state-space vector, u(t) is the 2×1 vector of controller outputs (opening of production choke 2 and gas injection choke 3). y(t) is the p×1 vector of controller inputs (in preferred mode y(t) corresponds to measured and/or estimated physical quantity). r(t) is the q×1 vector of the externally given operating point. The parameters of the matrices $A_c$,$B_c$,$C_c$,$D_c$,$E_c$ and $F_c$ depend on the parameters in the linear state-space gas lifted well model in the operating point in question. These linear state-space models, representing the linear model-based linear stabilizing gas lifted well controllers, have the following inputs:

Wellhead pressure 11 and/or

Bottom hole pressure 16 and/or

Casing pressure 14 and/or

Mass rate of gas through gas injection valve 17 and/or

Casing temperature 18 and/or

Mass rate of gas through gas injection choke 15 and/or

Pressure and temperature upstream the gas injection choke and/or

Pressure and temperature in the reservoir and/or

Pressure downstream the production choke and

Externally given (optimal) reference operating point and the following outputs:

Opening of the gas injection choke 3 and/or

Opening of the production choke 2

Figure 10:
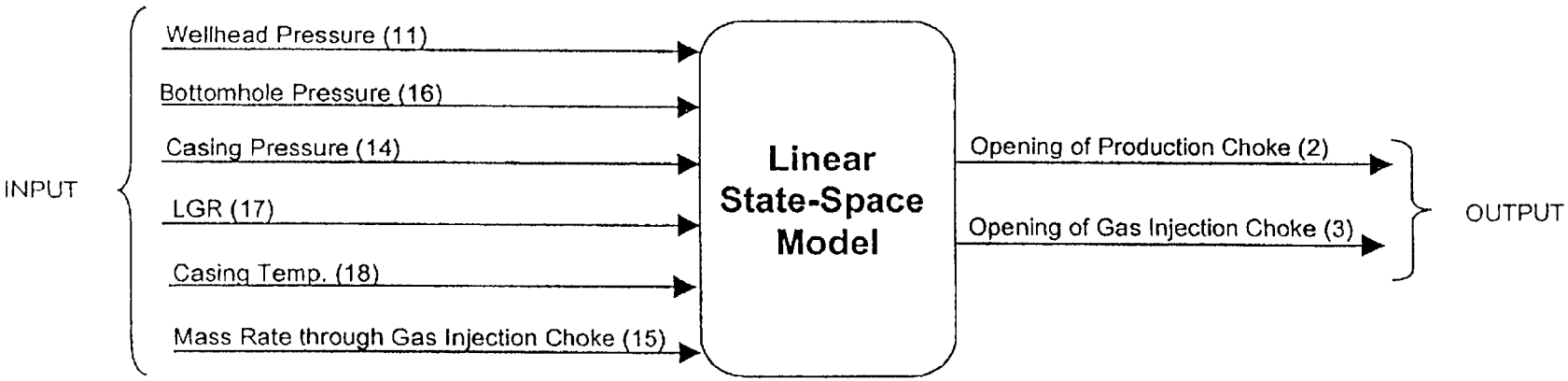
FIG. 10 shows an illustration of input and output for the linear state-space model representing a locally linear stabilizing gas lifted well controller.

FIG. 10 shows all possible inputs and outputs for the linear state-space models representing a linear stabilizing gas lifted well controller.

Figure 11:
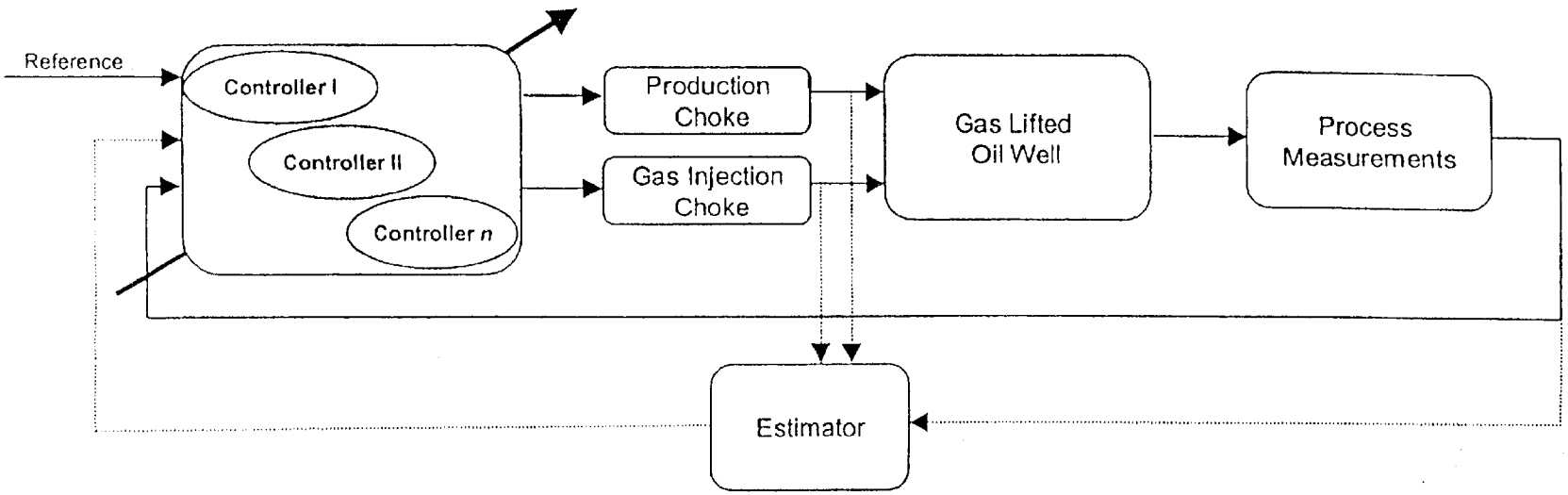
FIG. 11 shows the total invented model-based stabilizing gas lift controller consisting of several stabilizing gas lift controllers.

In order to generate globally model-based stabilizing gas lifted well controllers, our innovative idea is to combine the model-based linear locally stabilizing gas lifted well controllers described above. Each total model-based gas lifted well controller will then consist of a family of model-based linear stabilizing controllers, each of which will be valid in a predefined neighborhood of an open-loop unstable operating point, and switching between the controllers will occur based on predefined logical rules. In addition to logical switching rules, we also include logic to prevent integrator windup whenever integral action is included in the controller. FIG. 11 illustrates the total gas lifted well controller, including several linear model-based stabilizing controllers.

EXAMPLES

Several control structures, in line with our general concept shown FIG. 4, with the ability to stabilize a gas lifted well in an operating point that is unstable in open-loop, are described in the examples that now follows. What is common for all these model-based controller concepts is that the heading phenomena is eliminated through active and continuous manipulation of the opening of the production choke 2 and/or the opening of the gas injection choke 3.

In the examples, the gas lifted well is modeled in the multiphase simulator OLGA and the model-based gas lift controller is implemented in MATLAB. The experiments have been done in MATLAB using ABBs MATLAB/OLGA link.

Example 1

Figure 12:
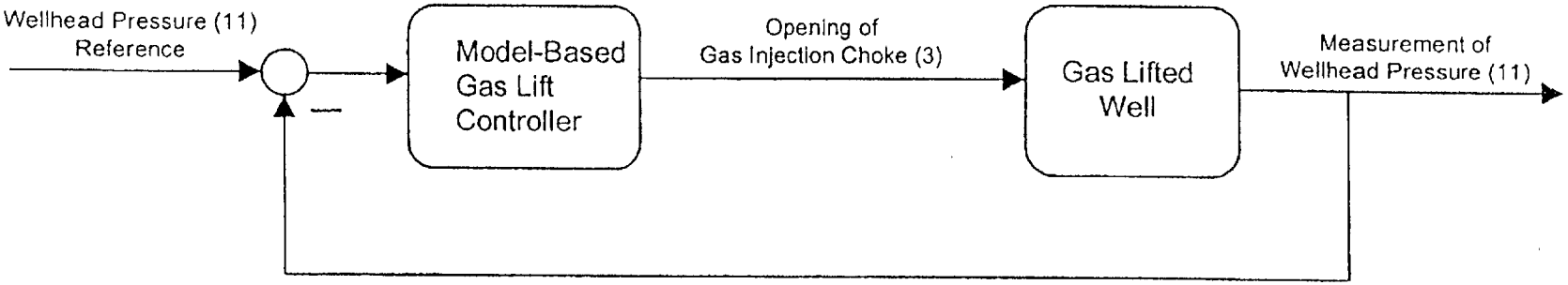
FIG. 12 shows the structure for stabilization of the gas lifted well using measurements of wellhead pressure and a model-based controller for manipulation of the gas injection choke.
Figure 13:
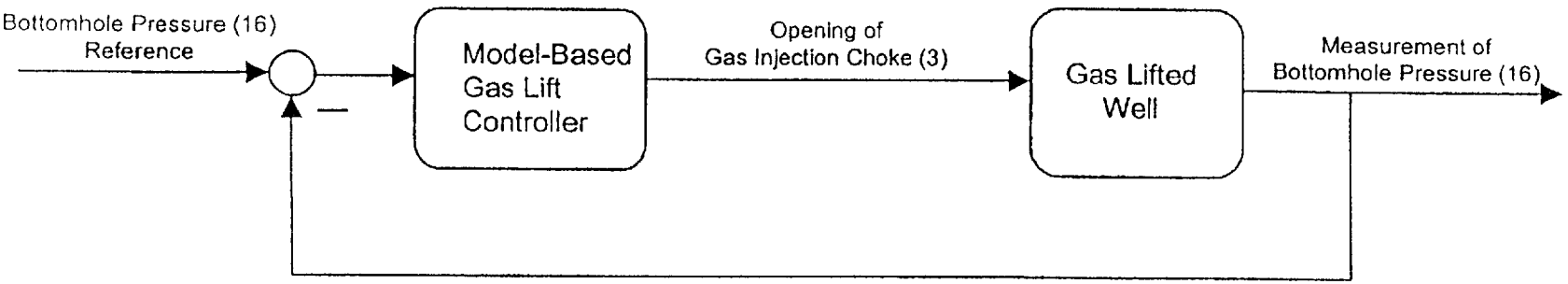
FIG. 13 shows the structure for stabilization of the gas lifted well using measurements of bottom hole pressure and a model-based controller for manipulation of the gas injection choke.

Using only measurements of pressure in the production tubing 1 as input to a model based gas lift controller, the gas lifted well may be stabilized only through dynamic manipulation of the gas injection choke 3. Pressure in production tubing 1 may be measured anywhere between the bottom of the well, i.e. bottom hole pressure 16, to the wellhead 9, i.e. wellhead pressure 11. FIG. 12 and FIG. 13 shows the controller structure using measurements of wellhead pressure 11 and bottom hole pressure 16.

Figure 14:
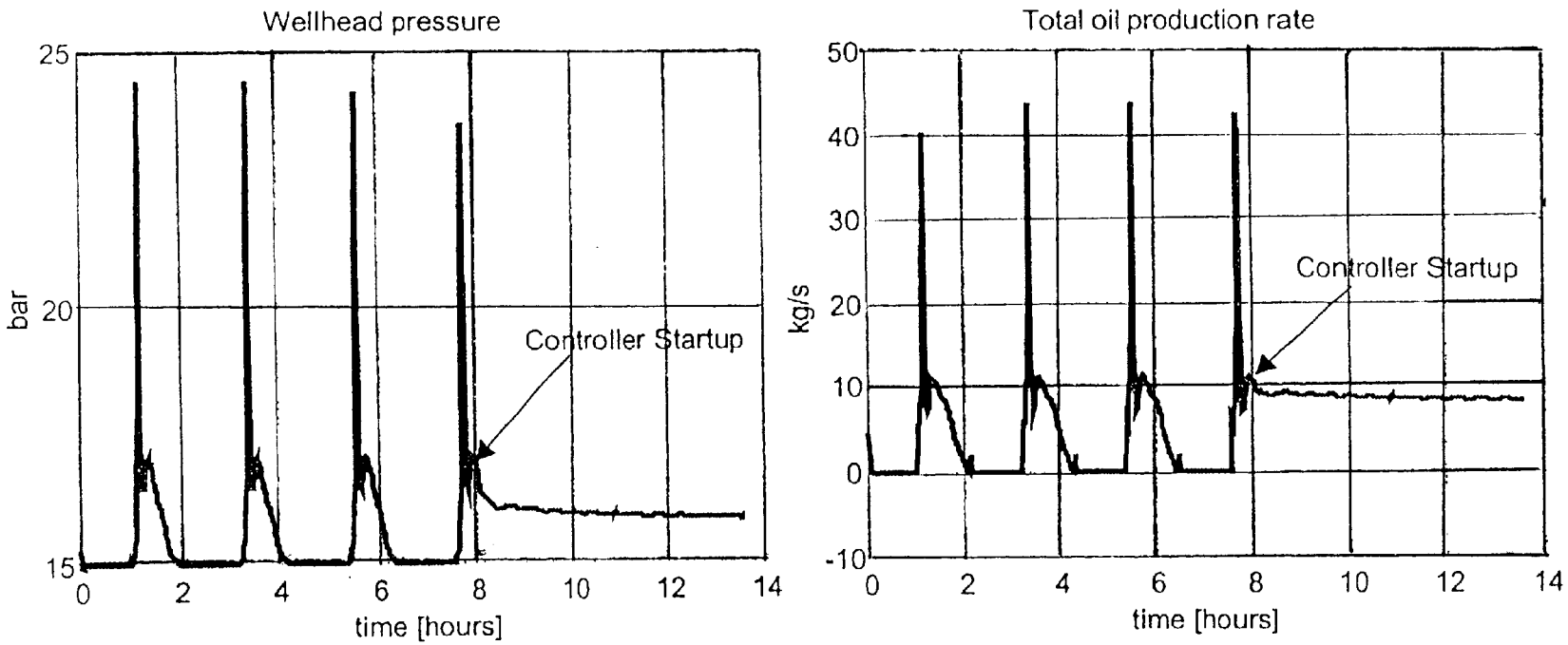
FIG. 14 shows stabilization of WHP (left) and stabilization of the oil production rate (right).

Simulations are performed where the controller manipulates the gas injection choke 3 in order to stabilize the wellhead pressure 11. FIG. 14 shows simulation results for this control concept. The controller starts after eight hours of open-loop simulations.

Example 2

Figure 15:
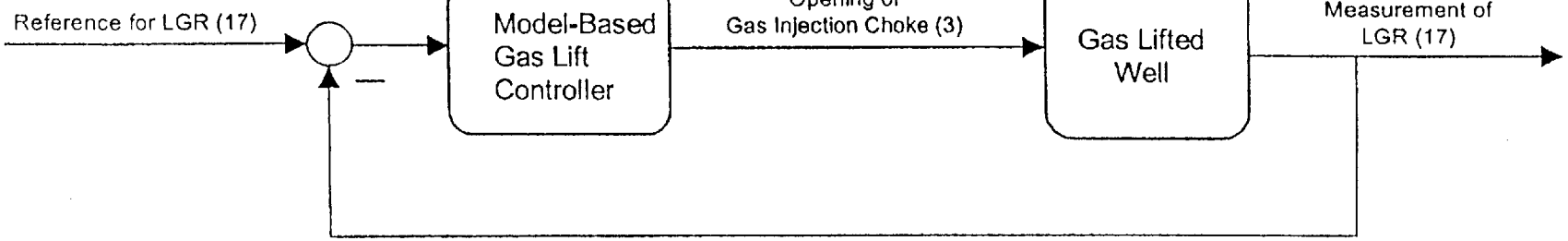
FIG. 15 shows the structure for stabilization of the gas lifted well using measurements of LGR and a model-based controller for manipulation of the gas injection choke.

Using only measurements of the LGR 17 as input to a model based gas lift controller, the gas lifted well may be stabilized only through dynamic manipulation of the gas injection choke 3. The controller structure using this measurement is shown in FIG. 15.

Figure 16:
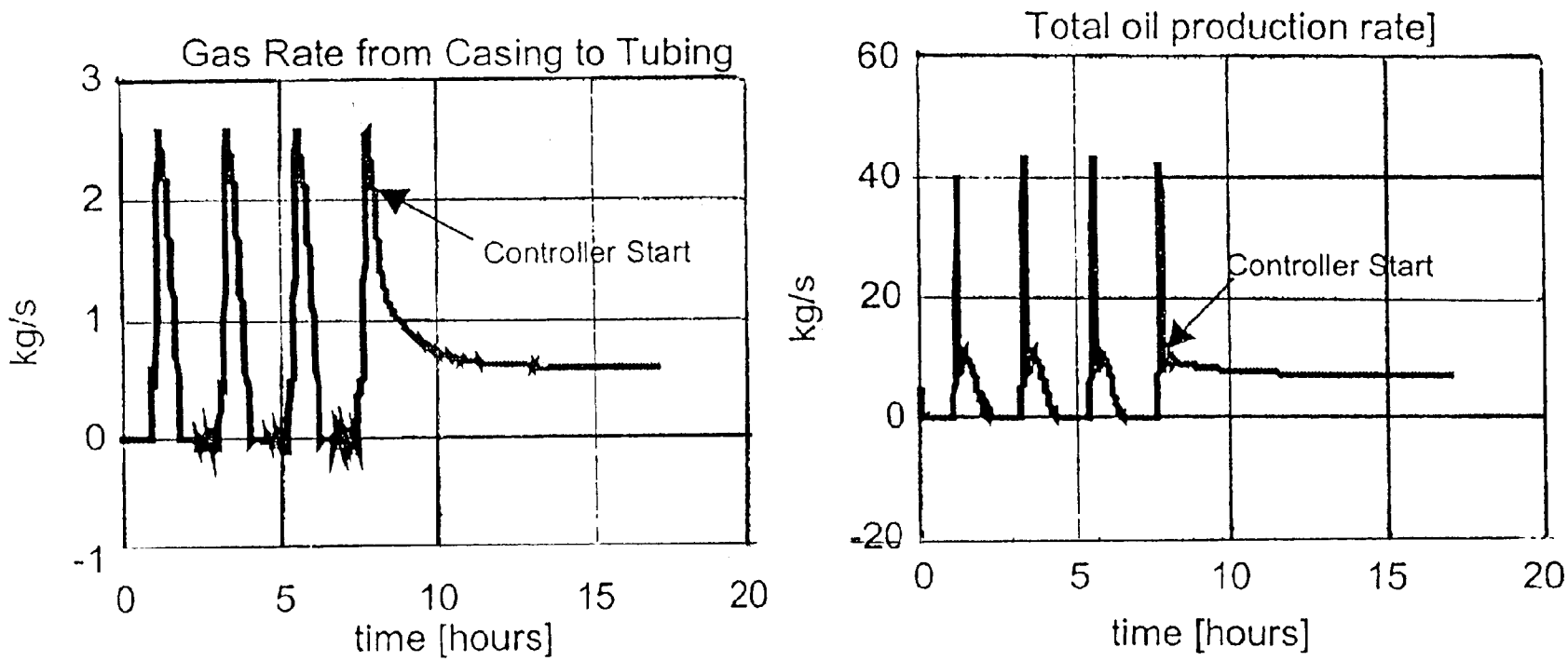
FIG. 16 shows stabilization of LGR (left) and stabilization of the oil production rate (right).

Results from simulations where the model-based controller is used for manipulation of the gas injection choke 3 for stabilization of LGR 17, are shown in FIG. 16. The controller starts after eight hours of open-loop simulations.

Example 3

If measurements of LGR 17 through the active gas injection valve 6 are not available, a non-linear model-based dynamic estimator may be used to estimate this rate. The estimator may use the measurements of the gas injection rate through the gas injection choke 15, temperature in casing 18 and pressure in casing 14. In addition to these measurements, the estimator may use the opening of the gas injection choke 3 itself.

Figure 17:
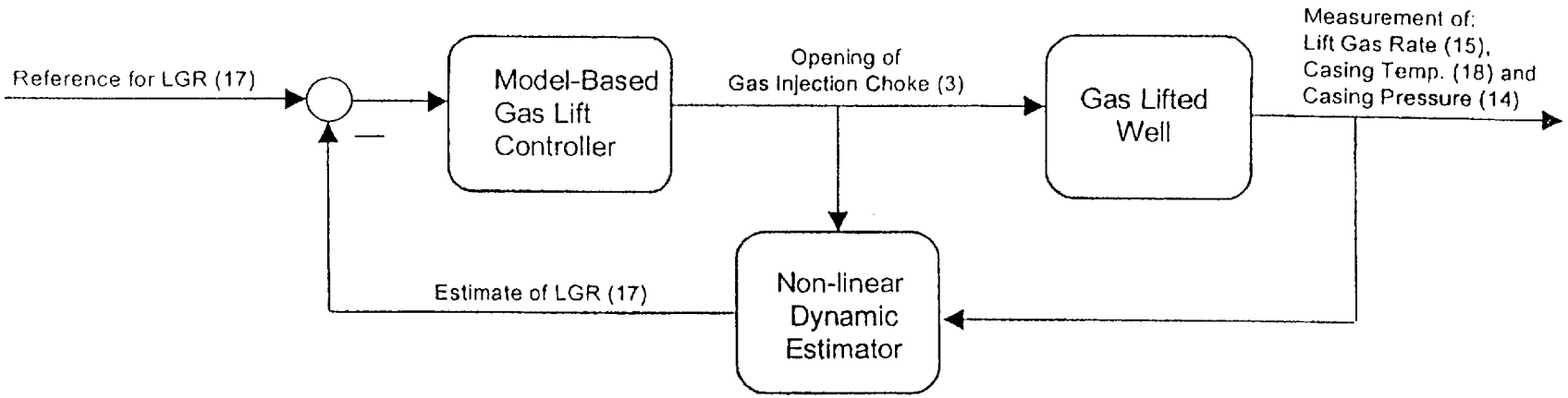
FIG. 17 shows the structure for stabilization of the gas lifted well using an estimate of LGR and a model-based controller for manipulation of the gas injection choke.

Using only an estimate of LGR 17 (based upon the non-linear model-based dynamic estimator described above) as input to a model-based dynamic gas lift controller, the gas lifted well will be stabilized only through dynamic manipulation of the gas injection choke 3. The lift gas rate 17 is controlled indirectly when using the estimator. The controller structure using the estimator is shown in FIG. 17.

Figure 18:
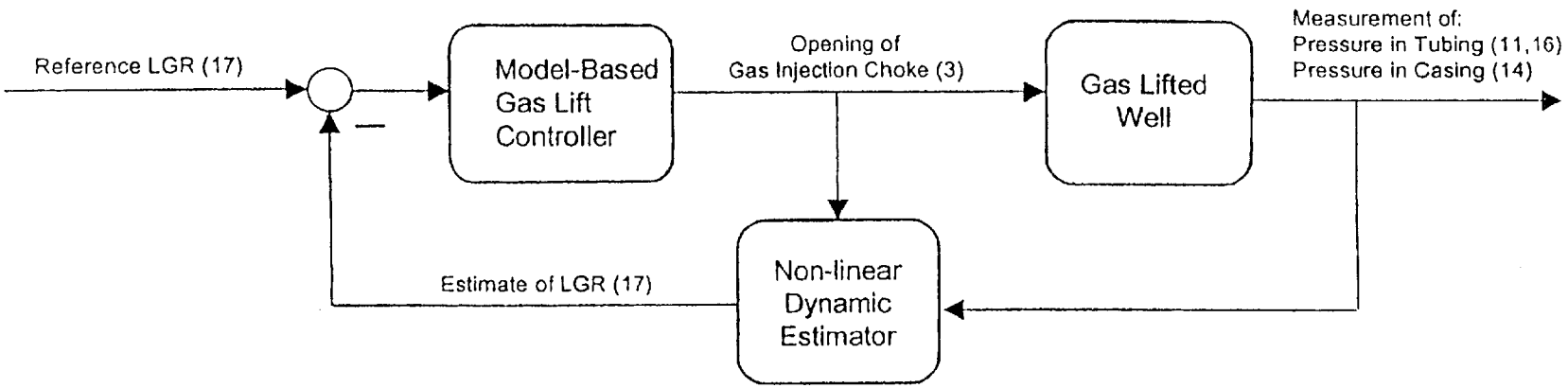
FIG. 18 shows the structure for stabilization of the gas lifted well using an estimate of LGR and a model-based controller for manipulation of the gas injection choke.

Using measurements of the pressure in the production tubing 16, 11 the pressure in the casing 14 and the opening of the gas injection choke, LGR 17 may be estimated. Based upon this estimate, LGR 17 may be controlled indirectly only through dynamic manipulation of the gas injection choke 3. The controller structure using an estimate of lift gas rate 17 is shown in FIG. 18.

Example 4

Figure 19:
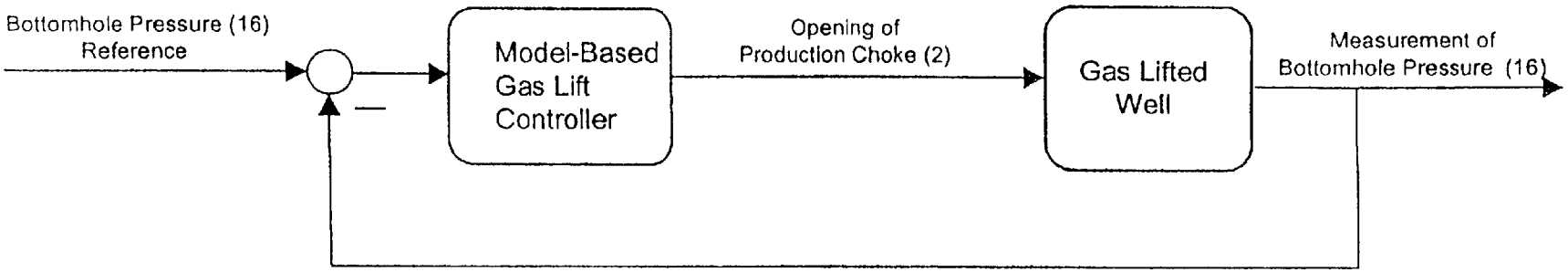
FIG. 19 shows the structure for stabilization of the gas lifted well using measurements of bottom hole pressure and a model-based controller for manipulation of the production choke.

Using only measurements of bottom hole pressure 16 as input to a model based gas lift controller, the gas lifted well will be stabilized only through dynamic manipulation of the production choke 2. The controller structure using this measurement is shown in FIG. 19.

Figure 20:
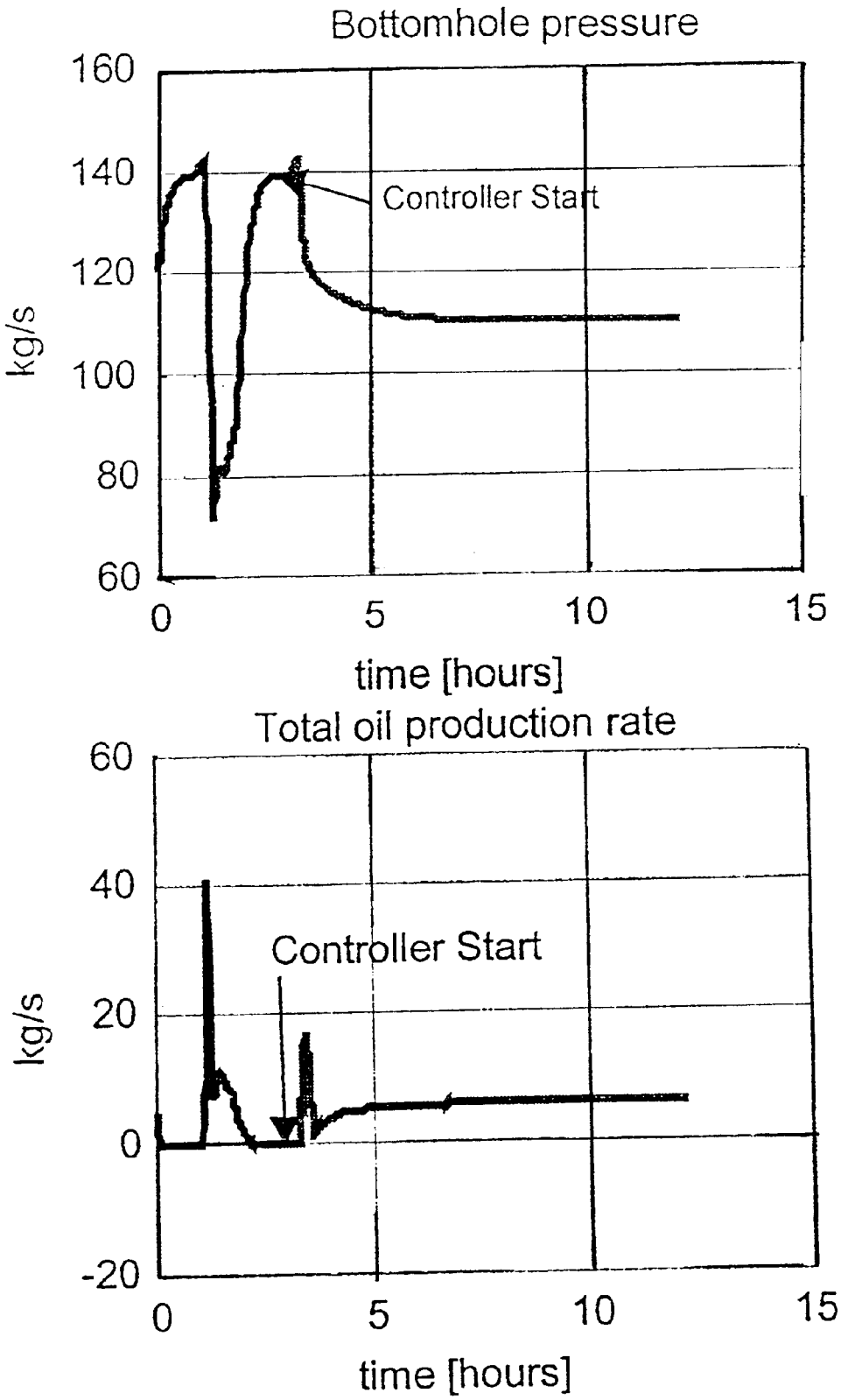
FIG. 20 shows stabilization of bottom hole pressure (left) and stabilization of the oil production rate (right).

Results from simulations where the model-based controller is used for manipulation of the production choke 2 for stabilization of the bottom hole pressure 16 is shown in FIG. 20. The controller starts after three hours of open-loop simulations.

Example 5

Figure 21:
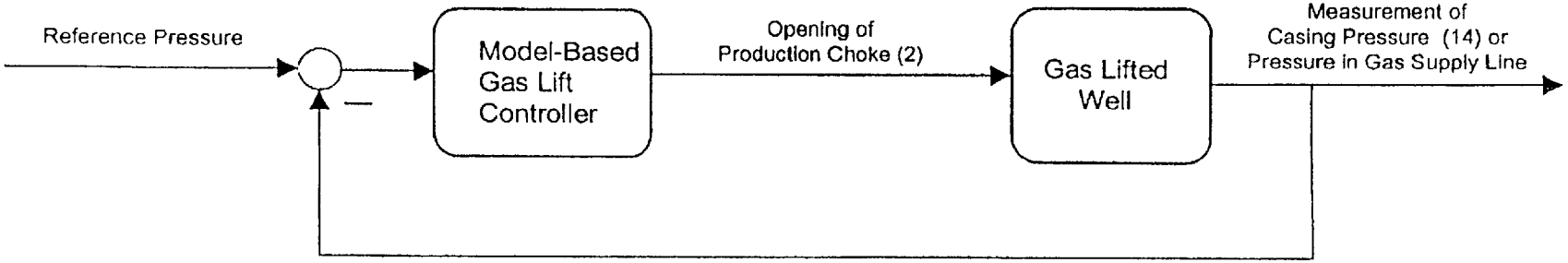
FIG. 21 shows the structure for stabilization of the gas lifted well using measurements of casing pressure and a model-based controller for manipulation of the production choke.

Using only measurements of pressure in casing 14 as input to a model based gas lift controller, the gas lifted well will be stabilized only through dynamic manipulation of the production choke 2. The controller structure using this measurement is shown in FIG. 21.

Figure 22:
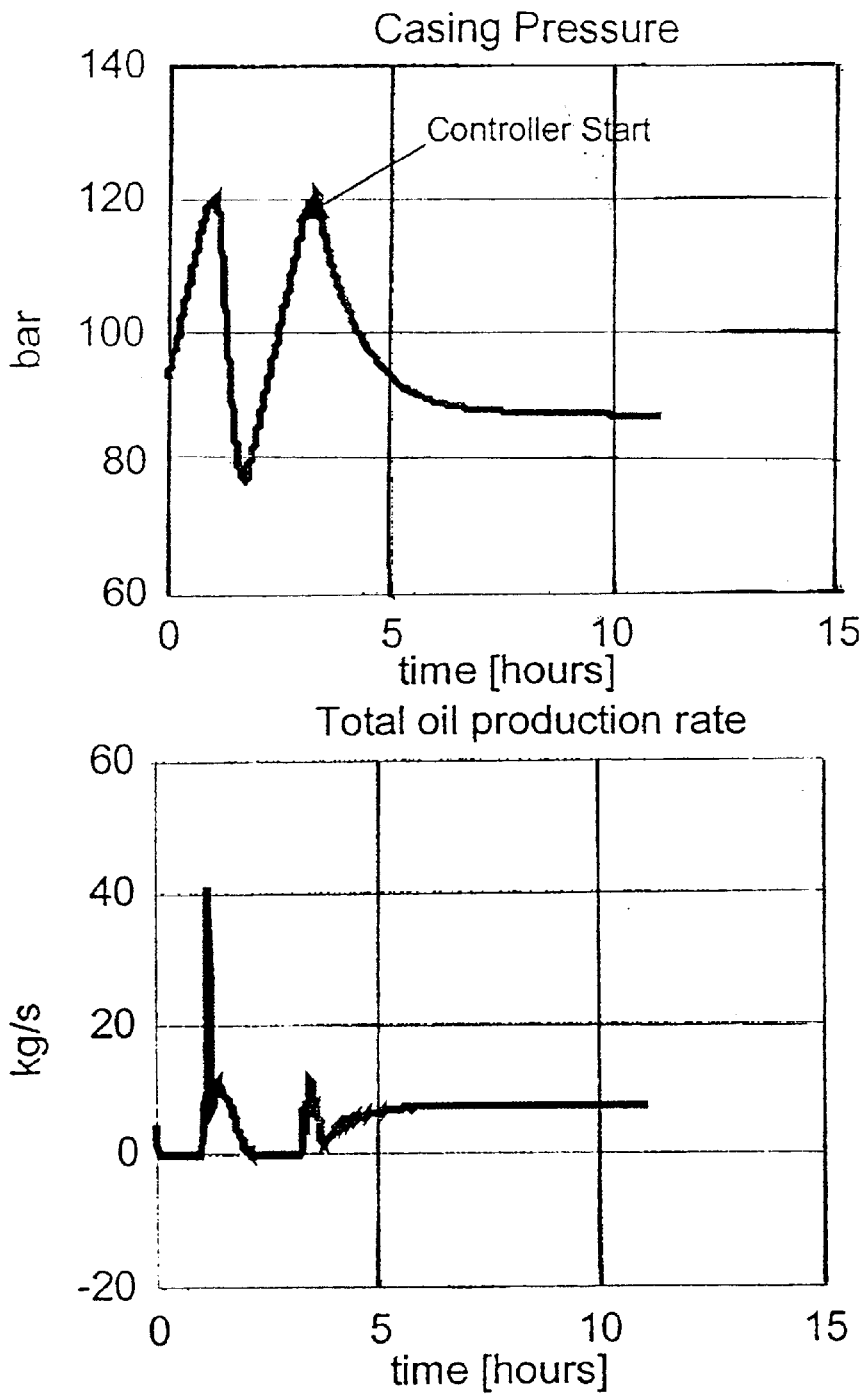
FIG. 22 shows stabilization of casing pressure (left) and stabilization of the oil production rate (right).

Results from simulations where the model-based controller is used for manipulation of the production choke 2 for stabilization of the bottom hole pressure 16 is shown in FIG. 22. The controller starts after three hours of open-loop simulations.

Example 6

Several measurements, and/or an estimate of one or more of these, may be used as input to a multivariable model-based gas lift controller. On possible structure for this multivariable controller is shown in the example below.

Figure 23:
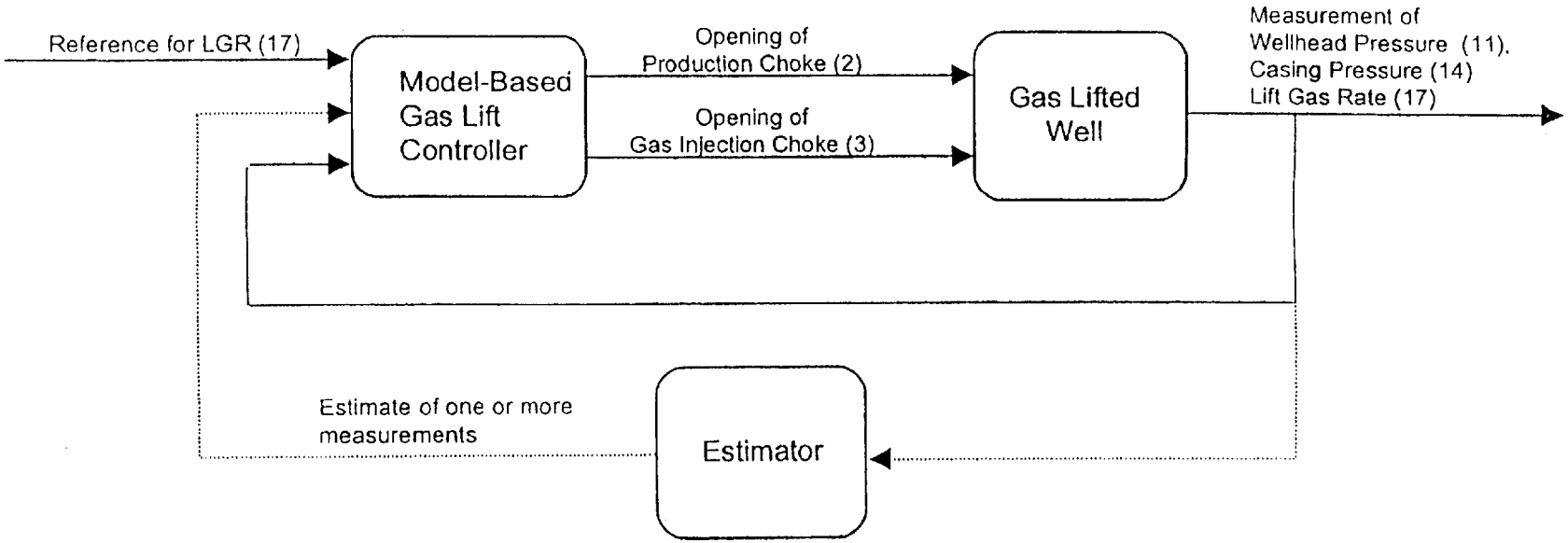
FIG. 23 shows the multivariable control structure for stabilization of the gas lifted well using measurements of wellhead pressure, casing pressure, LGR and a model-based controller for manipulation of the production choke and the gas injection choke.

Using measurements of pressure in the casing 14, pressure at the wellhead 11 and LGR 17 as input to a multivariable model-based gas lift controller, the gas lifted well will be stabilized through dynamic manipulation of both the production choke 2 and the gas injection choke 3. The controller structure using these measurements is shown in FIG. 23.

Figure 24:
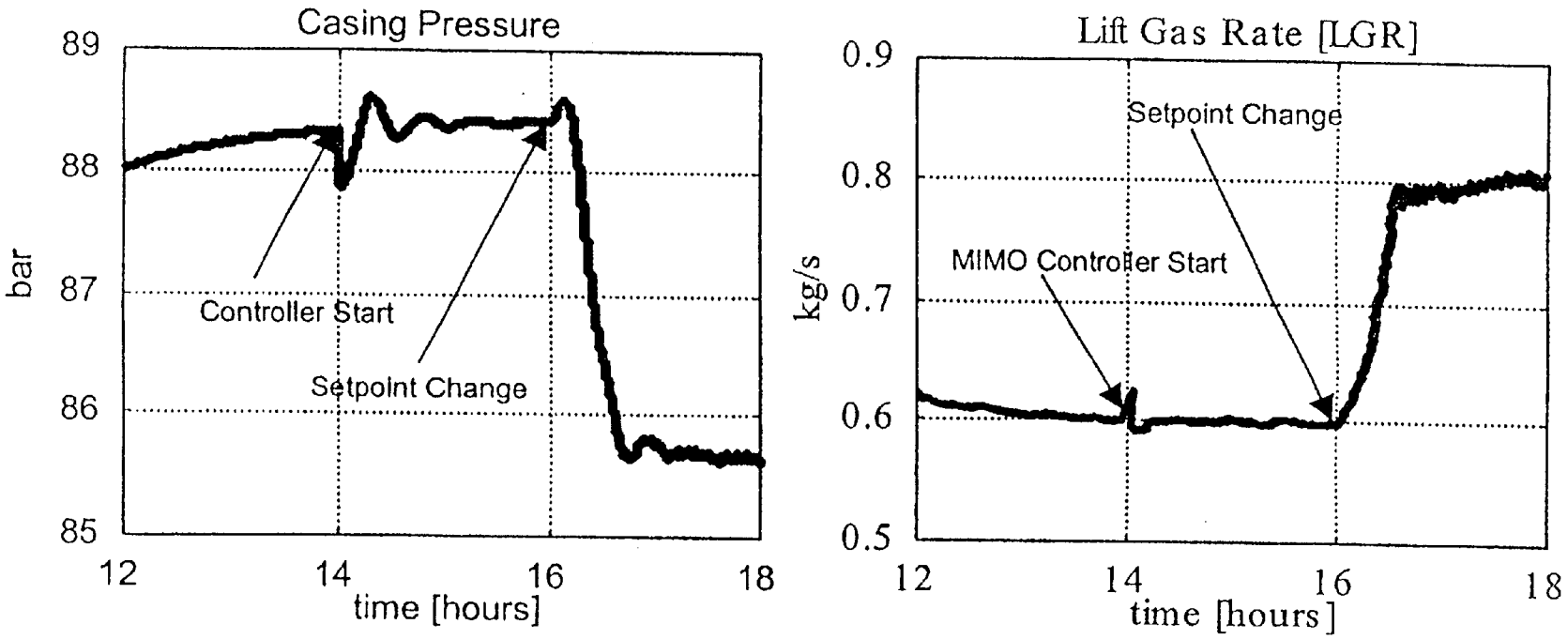
FIG. 24 shows stabilization of casing pressure (left) and stabilization of LGR (right).
Figure 25:
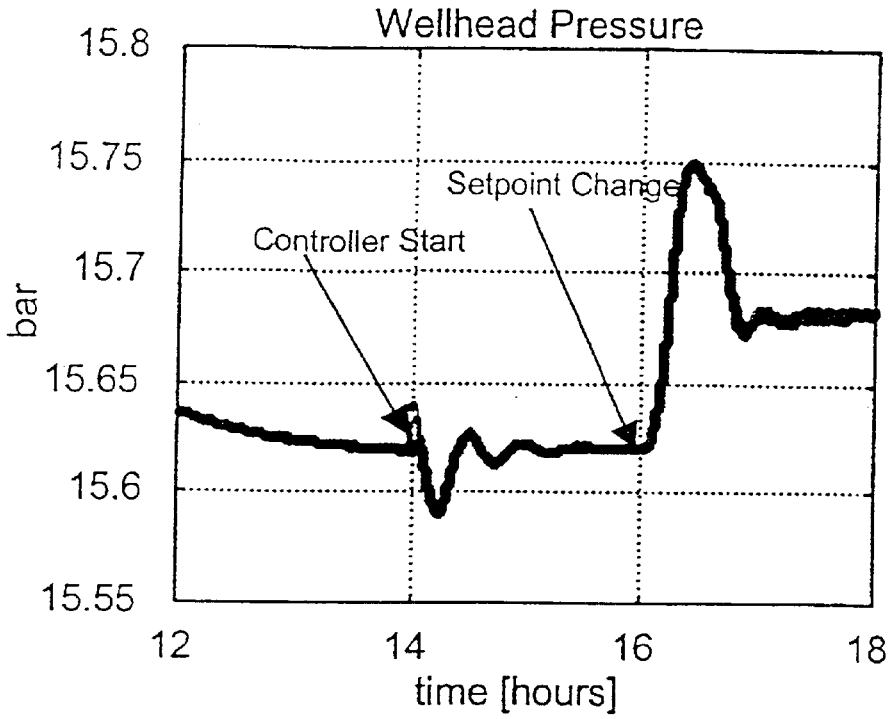
FIG. 25 shows stabilization of wellhead pressure (left) and stabilization of oil production rate (right).
Figure 25:
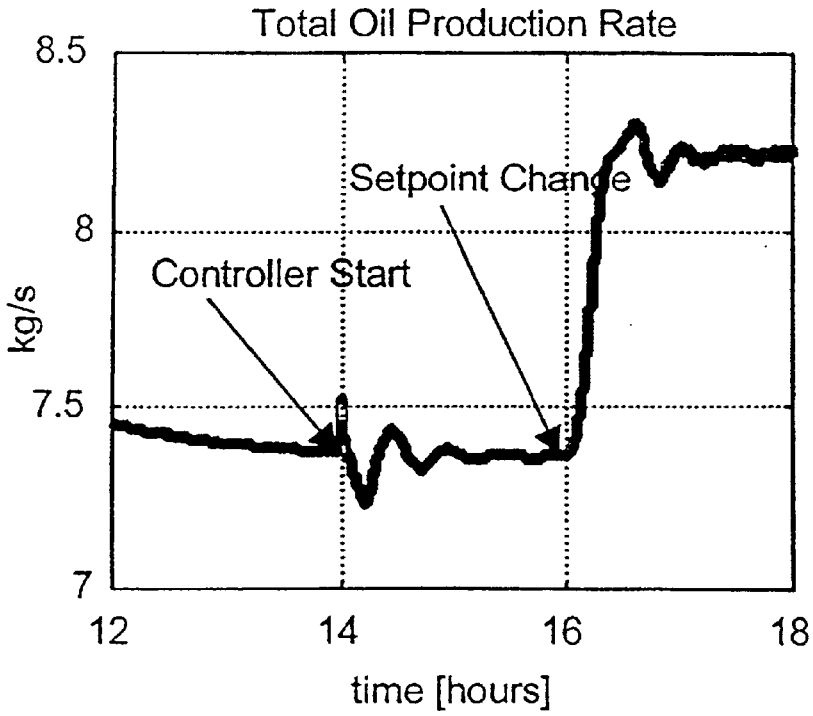

Results from simulations where the model-based controller is used for manipulation of the production choke 2 and the gas injection choke 3 for stabilization of the gas lifted well, is shown in FIG. 24 and in FIG. 25. The multivariable controller starts after fourteen hours and after sixteen hours the setpoint for LGR 17 is ramped from 0.6 kg/s to 0.8 kg/s.

Example 7

From closed-loop experiments, we have invented a way to tune the controller parameters on-line (c.f. page 15). Tests have successfully been performed for on-line tuning.

To determine the optimum setpoint value, a logic sequence combined with a stepwise approach has been used. Using this method to determine the optimum setpoint value, no other inputs will be required from the well.

What is claimed is:

1. Method for controlling the production flow rate of an oil well, said well comprising a production tubing with at least one production choke and gas injection means including at least one gas injection choke, characterized in that at least one of the chokes being continuously controlled actively by means of a model-based control system comprising a stabilizing controller based on dynamic feedback from at least one selected from the group of measurements of pressure, model-based calculations of pressure, temperatures or flow rates in the well, said pressure, temperatures and flow rates being actively stabilized by said model-based control system at a specified operation point, even if the specified operation point is unstable in an open loop.

2. Method according to claim 1, characterized in that a mathematical dynamic model is made of the well, the model being comprised in the model-based control system in association with the stabilizing controller and having the ability to describe and recreate unstable limit cycles that may occur in pressures, temperatures and flow rates in the production tubing and/or gas supply means included in the gas injection means for supply of pressurized gas to the lower end of the production tubing.

3. Method according to claim 2, characterized in that the stabilizing controller is designed and tuned based on the model.

4. Method according to claim 2, characterized in that the mathematical dynamic model of the well system is non-linear, in order to capture the behavior over a wide operating range, and based on ordinary differential and algebraic equations.

5. Method according to claim 2, characterized in that one or more of the parameters in the model are adjusted in order to fit the model measured time series of pressure, temperature and flow rates from a well.

6. Method according to claim 2, characterized in that one or more of the parameters in the model are adjusted in order to fit the model to simulated time series of pressures, temperatures and flow rates from a well which is modeled in a rigorous multiphase pipeline simulator based on partial differential-algebraic equations.

7. Method according to claim 2, characterized in that the model is a combination of a number of linear state-space models, each linear state-space model being represented by a set of system matrices or an equivalent representation, each linear state-space model simulating the dynamic behavior of an oil well in the neighborhood of an open-loop unstable operational point, each linear state-space model comprising one or both of the following inputs:

opening of the gas injection choke, opening of the production choke, and comprising one or more of the following outputs:

wellhead pressure, bottom hole pressure, casing pressure/pressure in gas supply tubing, mass rate of gas through gas injection valve, casing temperature/temperature in gas supply tubing, mass rate of gas through gas injection choke, and, if necessary, one or more of the following disturbances:

pressure and temperature upstream the gas injection choke, pressure and temperature in the reservoir, pressure downstream the production choke.

8. Method according to claim 7, characterized in that each linear model is derived through a numeric or algebraic linearization of a non-linear dynamic model of the well system, with the ability to capture the behavior over a wide operating range and being based on ordinary differential and algebraic equations.

9. Method according to claim 8, characterized in that the linear state-space models comprising the stabilizing controllers are derived based on the linear state-space models comprising a dynamic well model.

10. Method according to claim 7, characterized in that each linear state-space model is identified through experimental closed-loop perturbation of a well system which is modeled in a multi-phase pipeline simulator.

11. Method according to claim 2, characterized in that the stabilizing controller is represented as a combination of a number of linear state-space models, each linear state-space model being represented by a set of system matrices or an equivalent representation, each linear state-space model simulating the dynamic behavior of a linear stabilizing well controller in such a way that an open-loop unstable operating point for pressures, temperatures and flow rates is stabilized in closed-loop in the neighborhood in which the linear state-space model is valid, each linear state-space model comprising one or more of the following inputs:

wellhead pressure, bottom hole pressure, casing pressure/pressure in gas supply tubing, mass rate of gas through gas injection valve, casing temperature/temperature in gas supply tubing, mass rate of gas through gas injection choke, and comprising one or more of the following outputs:

opening of the gas injection choke, opening of the production choke.

12. Method according to claim 11, characterized in that linear state-space models comprising the stabilizing controllers are derived based on the linear state-space models comprising a dynamic well model.

13. Method according to claim 2, characterized in that the stabilizing controller is represented by a set of non-linear ordinary differential equations and/or algebraic equations in order to stabilize the well system over a wide operating range.

14. Means for stabilizing a well by controlling the production flow rate of an oil well, said well comprising a production tubing with at least one production choke and gas injection means including at least one gas injection choke, characterized in that one or more of the chokes being continuously controlled actively as a function of process measurements, and/or model-based calculations of pressure, temperature and flow rates, the means being adapted to:

monitor, measure and/or calculate process parameters relating to the well, the production of the well and the conditions in the gas injection means, continuously and actively control one or more of the chokes by means of a model-based control system including a stabilizing controller based on dynamic feedback of selected available measurements and/or model based calculations of said pressure, temperatures and/or flow rates, as said pressure, temperatures and flow rates are stabilized by the model-based control system in a specified operation point, which also can be unstable in open loop.

15. Means for stabilizing a well according to claim 14, characterized in that said stabilizing controller comprises a number of stabilizing controllers, each of which being valid in a predefined neighborhood of an open-loop unstable operating point, and that the controller comprises or is associated with means for switching between said controllers based on predefined logical rules comprised in the mathematical model.

16. Means for stabilizing a well according to claim 14, characterized in that it comprises built-in logic and/or non-linearities to prevent integrator windup and input saturation.

17. Means for stabilizing a well according to claim 14, characterized in that it manipulates the opening of the gas injection choke using process measurements of pressure in the production tubing as input.

18. Means for stabilizing a well according to claim 17, characterized in that it uses measurements of the pressure in the production tubing as input.

19. Means for stabilizing a well according to claim 17, characterized in that it uses measurements of wellhead pressure as input.

20. Means for stabilizing a well according to claim 14, characterized in that it manipulates the opening of the gas injection choke using a measurement of a lift gas rate from casing/gas supply tubing to the production tubing as input.

21. Means for stabilizing a well according to claim 14, characterized in that it includes a non-linear dynamic well measurement filter (model-based estimator), said estimator being arranged to utilize the controlled measurements of the gas injection rate through the gas injection choke, temperature and pressure in casing/gas supply tubing, and said estimator calculates the rate of lift gas through the active gas injection valve.

22. Means for stabilizing a well according to claim 14, characterized in that said controller based on an estimate from a non-linear gas lift filter is arranged to manipulate the opening of the gas injection choke in order to indirectly control the lift gas rate from casing/gas supply tubing to the production tubing.

23. Means for stabilizing a well according to claim 14, characterized in that said controller is arranged to, on the basis of an estimate based on measurements of pressure in the production tubing and pressure in casing/gas supply tubing, manipulate the opening of the gas injection choke in order to indirectly control a lift gas rate from casing/gas supply tubing to the production tubing.

24. Means for stabilizing a well according to claim 14, characterized in that said controller is arranged to, based on measurements of the bottom hole pressure as input, manipulate the opening of the production choke.

25. Means for stabilizing a well according to claim 14, characterized in that said controller is arranged to, based on a measurement of pressure in casing/gas supply tubing as input, manipulate the opening of the production choke.

26. Means for stabilizing a well according to claim 14, characterized in that said controller is arranged to, based on a measurement of pressure in casing/gas supply tubing and at a wellhead as input, manipulate the opening of both the production choke and the gas injection choke.

27. Means for stabilizing a well according to claim 14, characterized in that said controller is arranged to at any time minimize the deviation between an optimal reference operating point and a real operating point (control error), with respect to a given time horizon.

28. Means for stabilizing a well according to claim 27, characterized in that said controller is arranged to by itself finding the optimal reference operating point at an optimal gas injection rate from casing/gas supply tubing to the production tubing.

29. Means for stabilizing a well according to claim 14, characterized in that said controller is arranged to adjust parameters in the controller on-line through closed-loop perturbations.

* * * * *